United States Patent [19]

Tomei et al.

[11] Patent Number: 4,720,876

[45] Date of Patent: Jan. 26, 1988

[54] SHOWER DOOR SYSTEM

[75] Inventors: Vincent Tomei; Alfred MacLean, both of Toronto; Michel Morand, Montreal; John Faveri, Toronto, all of Canada

[73] Assignee: Fasco Products Division of Indal Limited, Downsview, Canada

[21] Appl. No.: 895,677

[22] Filed: Aug. 11, 1986

[51] Int. Cl.[4] ..... A47K 3/22

[52] U.S. Cl. ..... 4/614; 4/607; 4/600; 4/610; 4/612; 49/371; 49/388

[58] Field of Search ..... 4/596, 597, 599, 600, 4/607, 608, 610, 612, 613, 614; 52/71, 79.5; 49/388, 371

[56] References Cited

U.S. PATENT DOCUMENTS

| | | | |
|---|---|---|---|
| 2,154,641 | 4/1939 | Seaman | 49/371 X |
| 2,939,527 | 6/1960 | Cann | 49/371 X |
| 3,331,159 | 7/1967 | Cooke et al. | 49/371 |
| 4,416,086 | 11/1983 | Niekrasz | 49/388 |
| 4,646,472 | 3/1987 | Sugawara | 49/388 X |

FOREIGN PATENT DOCUMENTS

| | | | |
|---|---|---|---|
| 1334731 | 9/1962 | France | 4/596 |
| 2056519 | 3/1981 | United Kingdom | 4/596 |

*Primary Examiner*—Henry K. Artis
*Attorney, Agent, or Firm*—Ivor M. Hughes

[57] ABSTRACT

In combination a shower stall structure for bathtubs or shower basins having a top and bottom comprising at least one opening extending from top to bottom defined by a multiplicity of stiles each stile extending in both a horizontal and vertical direction abutting an adjacent wall or stile, wherein at least one opening is closed by more than one closure member spanning across the at least one opening, having pivot mechanisms carried by both the multiplicity of stiles and the more than one closure member at the peripheral extremities thereof wherein the pivot mechanisms are adjustable in position along the respective peripheral edges of at least one of the multiplicity of stiles and the more than one closure member, allowing for dimensional variation of such as the at least one opening with respect to the dimensions of the corner in which the shower stall is installed.

42 Claims, 16 Drawing Figures

FIG. 6.
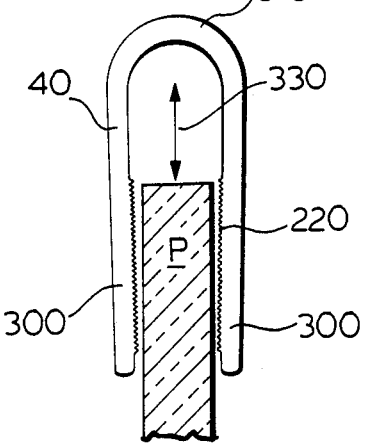
FIG. 6A.
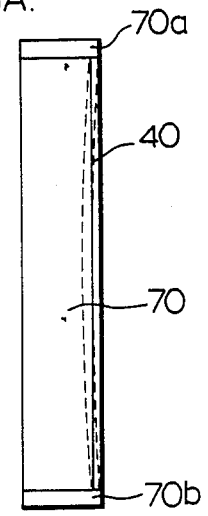
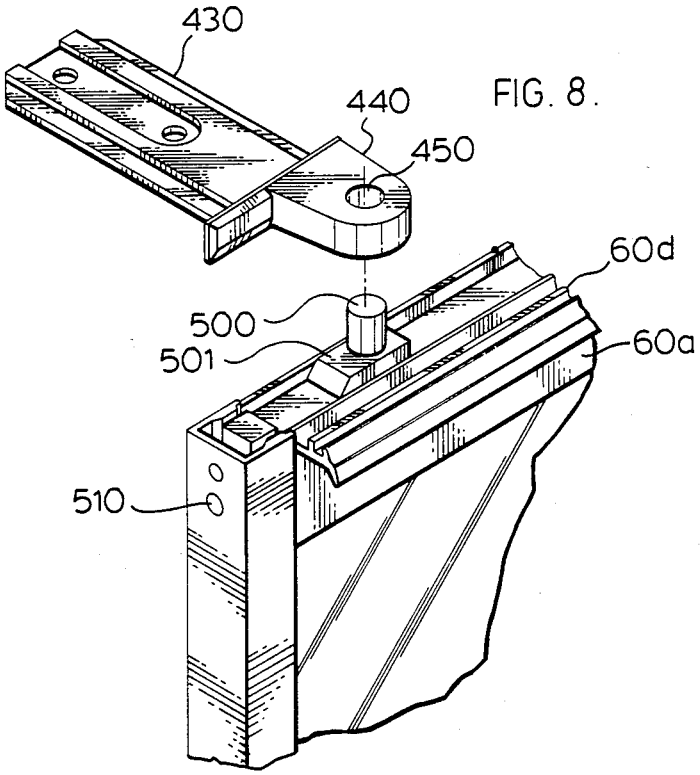
FIG. 8.

SHOWER DOOR SYSTEM

FIELD OF INVENTION

The present invention relates to shower stall structures for such as bath tubs and shower basins, having at least one opening closed by more than one closure member opening across the at least one opening.

BACKGROUND OF THE INVENTION

Shower stalls per se are known in the art. Some shower stalls are structured for bathtubs or shower basins using conventional sliding doors, wherein the supporting means for each door are retained within separate parallel guide channels allowing the doors to co-operate in use. However, sliding door assemblies are limited and not readily applicable to tight installations such as corner stalls or tubs in that they generally require a minimum opening when the doors are overlapped, this opening of sufficient size to allow access or egress of an individual. Pivoting shower doors overcome this restriction as disclosed in U.S. Pat. Nos. 2,698,677, 3,390,486 and 4,035,957. Further, U.S. Pat. No. 4,375,736 (Equivalent Canadian Patent No. 1,147,600) as well as U.S. Pat. No. 3,390,486 disclose pivot members which are adjustable in position. Shower stalls of the type referenced are generally monolithic in nature providing a functional use but generally aside from the porcelain, chrome or etched glass contained thereon offer little in the way of design to enhance and not detract from or blend in with the general surroundings. German Patent Application No. 3,401,135 discloses a shower stall having a square basin upon which is assembled a closure member having two doors, but generally dealing with the novel hinging and sealing components of the doors. German patent specification No. 3,507,264 discloses a hinge arrangement upon which double doors (as illustrated in FIG. 2) may be hung. Further, German patent application No. 3,310,139 (now abandoned) discloses a shower partition for bath tubs or shower basins having double doors but not extending the full length of the stall to the sill of the shower basin. The aforementioned German references, however, do not allow for the variation in dimensions normally confronting an installer. Panels must be cut to size and more or less made to measure with no provision for adjustment during installation.

Notwithstanding, it is Applicant's intention to overcome the monolithic appearance of shower stalls disclosed in some of the prior art while allowing for flexibility, ease of installation and hence economy.

It is therefore an object of this invention to provide functional yet attractive shower stalls having a multiplicity of embodiments.

It is a further object of the invention to provide a shower stall having at least one opening defined by a multiplicity of stiles closed by more than one closure member spanning across the said at least one opening.

It is still a further object of the invention to provide a shower stall having at least one opening closed by more than one closure member having adjustable pivot members thereby providing for ease of installation and on site adjustment.

It is a further object of the invention to provide in kit form readily assembled by an installer a shower stall which is functional yet attractive having a multiplicity of embodiments when assembled and yet economical.

It is still a further object of the invention to provide a shower stall which can be fit dimensionally on the job site allowing installers to minimize their inventories of pre-cut panels.

It is a further object of the invention to eliminate in a preferred embodiment all vertical joints on the jamb which support the stile panels.

It is a further object of the invention in a preferred embodiment to minimize the number of vertical and horizontal extrusions such as the header.

It is a further object of the invention to provide a U-shaped channelled jamb which allows for alignment of all panels if such as a supporting wall is not plumb.

Further and other objects of this invention will become apparent to a man skilled in the art when considering the following summary of invention and the more detailed embodiments of the invention illustrated herein.

SUMMARY OF INVENTION

According to one aspect of the invention a new shower stall structure for bathtubs and shower basins having a top and bottom is provided comprising, in a preferred embodiment, at least one opening extending from top to bottom defined by a multiplicity of stiles each stile extending in both a horizontal and vertical direction abutting an adjacent wall or stile, wherein said at least one opening is closed by more than one closure member spanning across said at least one opening having pivot mechanisms carried by both said multiplicity of stiles and said more than one closure member, at the peripheral extremities thereof wherein said pivot mechanisms are adjustable in position along the respective peripheral edges of at least one of said multiplicity of stiles and said more than one closure member, allowing for dimensional variation of said at least one opening, with respect to the dimension of the corner in which the shower stall is installed.

According to another aspect of the invention a new shower stall structure for bathtubs and shower basins is provided having a top and bottom comprising in a preferred embodiment at least one opening extending from top to bottom defined by a multiplicity of stiles, each stile extending in both a horizontal and vertical direction abutting an adjacent wall or stile, wherein said at least one opening is closed by more than one closure member spanning across said at least one opening in inward overlapped relation with said multiplicity of stiles, having pivot mechanisms carried by both said multiplicity of stiles and said more than one closure member at the top and bottom extremities thereof wherein said pivot mechanisms are adjustable in position and in an alternative embodiment, having locking means disposed therein along the respective upper and lower edges of at least one of said multiplicity of stiles and said more than one closure member allowing for dimensional variation of said at least one opening with respect to the dimensions of the corner in which the shower stall is installed, according to the amount of overlap desired.

According to another aspect of the invention, in alternative embodiments a multiplicity of shower stalls having compatible geometry with the specific shower basins and bathtubs enclosed is provided comprising such shapes as square, rectangular, quarter round, and right-angled pentagonal, triangular, circular, and elliptical cross-section configurations (as best illustrated in FIG. 4).

According to another aspect of the invention, a disassembled kit for a shower stall structure for bath tubs and shower basins is provided comprising in a preferred embodiment once assembled at least one opening defined by a multiplicity of stiles each stile extending in both a horizontal and vertical direction abutting an adjacent wall or stile, wherein said at least one opening is closed by more than one closure member spanning across said at least one opening in inward overlapped relation with said multiplicity of stiles, having pivot mechanisms carried by both said multiplicity of stiles and said more than one closure member at the top and bottom extremities thereof, wherein said pivot mechanisms are adjustable in position and in an alternative embodiment, having locking means disposed therein along the respective upper and lower edges of at least one of said multiplicity of stiles and said more than one closure member allowing for dimensional variation for said at least one opening according to the amount of overlap desired, wherein said kit allows on site dimensional adjustment of the assembled shower.

According to another aspect of the invention, in a preferred embodiment, a new shower stall structure for bathtubs and shower basins is provided wherein the number of vertical extrusions is minimized and wherein such as silicone sealant is used to fasten abutting vertical edges further secured by such as tape.

According to another aspect of the invention, in a preferred embodiment, a new shower stall structure for bathtubs and shower basins is provided comprising a U-shaped channelled jamb having sufficient depth to permit sufficient adjustment of a stile to properly finish said shower stall even though the supporting wall is not plumb.

According to another aspect of the invention, a latch means is provided and in a preferred embodiment, said latch means comprises magnetic strips to seal the doors.

According to another aspect of the invention, a pivot block is incorporated within the extruded horizontal glazing section of the stile framing members.

According to another aspect of the invention, in an alternative embodiment thereof, the panels of various materials forming the stall are transparent, translucent, or opaque and of a multiplicity of colours.

According to another aspect of the invention, in a preferred embodiment thereof, the pivot mechanism carried by both said multiplicity of stiles and said more than one closure member at the upper and lower extremities thereof are provided comprising a pivot block or pivot pin disposed upon the inner and outer extremities of the panel framing extrusion of said shower stall, wherein at least one of said block and pin are adjustable in position such as telescopically or by an adjustment defined by a rotatable threaded pin in communication with said pivot mechanism.

According to another aspect of the invention, in an alternative embodiment thereof, the panel frame extrusions are fabricated from a multiplicity of materials including aluminum, plastic, compounded resins, metals and other miscellaneous extrudable materials.

BRIEF DESCRIPTION OF THE DRAWINGS

FIG. 6 is a top view of a U-shaped channelled jamb in a preferred embodiment of the invention.

FIG. 6A is a side view of a stile secured within within a U-shaped channelled jamb compensating for walls which are not plumb in a preferred embodiment of the invention.

FIG. 8 is a perspective view of a pivot pin component contained within a compatibly-shaped extruded glazing section in a preferred embodiment of the invention.

DETAILED DESCRIPTION OF THE DRAWINGS

Figure 1:
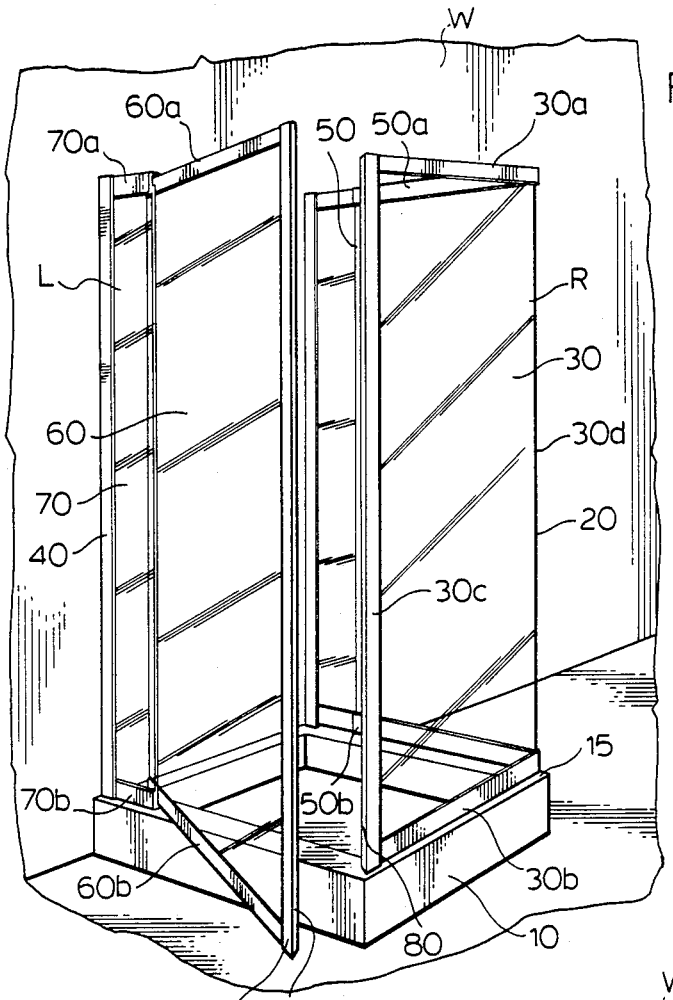
FIG. 1 is a perspective view of a square shower stall depicting the pivoting doors in a preferred embodiment of the invention.
Figure 1A:
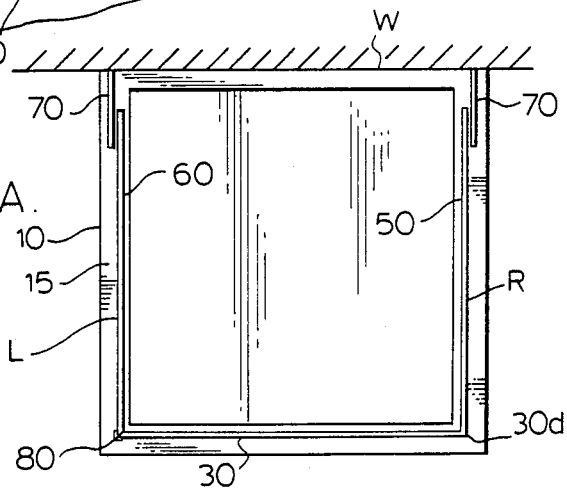
FIG. 1A is a top view of the shower stall of FIG. 1 illustrating the overlapping of the door and stile members in a preferred embodiment of the invention.
Figure 7:
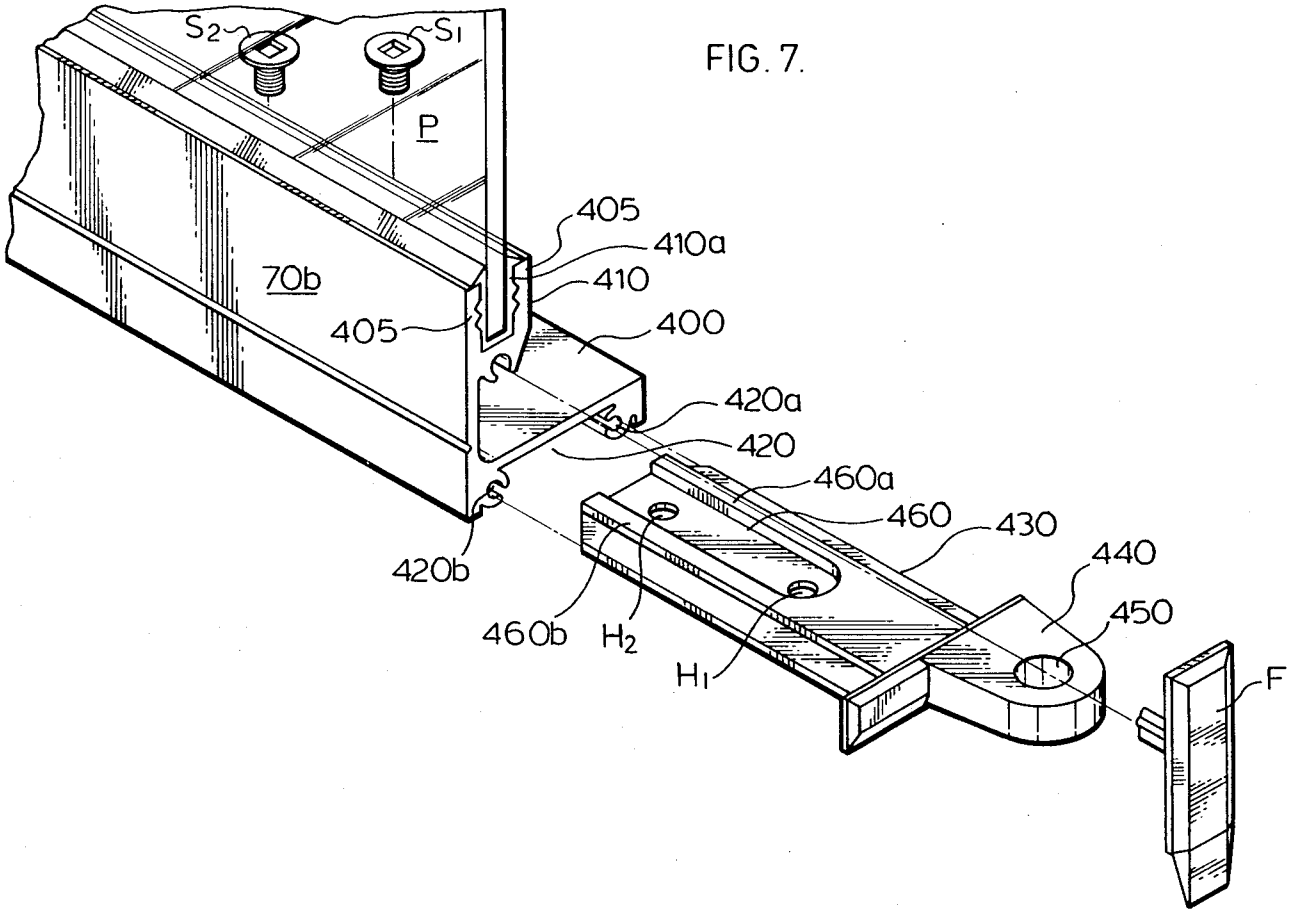
FIG. 7 is a perspective exploded view of a pivot block and the positioning thereof within a compatible extruded glazing section in a preferred embodiment of the invention.
Figure 9:
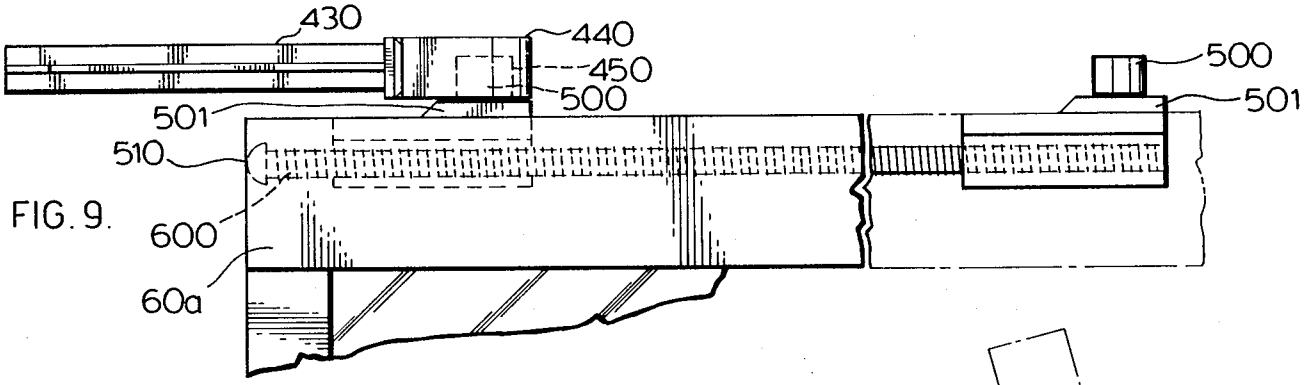
FIG. 9 is a side view of an extruded glazing section illustrating a threaded pin located therein for adjusting the positioning of the pivot pin member in a preferred embodiment of the invention.

Referring now to FIGS. 1 and 1A, shower stall generally referred to as 20 is illustrated in perspective and top view having a top and bottom and three sides generally described by panels 30, 50, 60 and wall W, it being understood that said panels may be constructed from a multiplicity of materials and colours which may be transparent, translucent, opaque, or any combination thereof; wherein said shower stail has upon its bottom a square-shaped shower basin. Fastened to wall W is U-shaped channelled jamb member 40 (as best illustrated in FIGS. 6 and 6A), which receives and fastens stiles 70 having top and bottom horizontal extrusions 70(*a*) and 70(*b*) affixed thereto and sustaining said stiles within which pivot blocks 440 (as best illustrated in FIG. 7) are secured top and bottom left and right with the holes 450 aligned to receive pivot pins 500 (as best illustrated in FIG. 8) secured within horizontal extrusions 60(*a*) and 60(*b*) upon which door members L (and R) compatibly pivot outwardly away from shower basin 10, wherein door L comprises panels 60 secured top and bottom by said horizontal extrusion members 60(*a*) and 60(*b*) and upon one side by an option vertical extrusion 60(*c*) having affixed to its seal surface a magnetic strip 80 compassing its height compatibly aligned with magnetic strip 80 of door member R having an invented "L" shape in this embodiment (it being understood that a mirror image of this embodiment of said shower stall 20 would operate identically) comprising panels 30 and 50, wherein panel 30 is secured top and bottom by horizontal extrusions 30(*a*) and 30(*b*) and upon one side by a vertical extrusion 30(*c*) having affixed to its sealing surface a magnetic strip 80 compassing its height and compatibly aligned with its complement upon door member L providing a firm seal, wherein panel 50 is secured top and bottom by horizontal extrusions 50(*a*), and 50(*b*) with which are secured pivot pins 500 (as best illustrated in FIG. 8) said pins 500 being inserted within the holes 450 of pivot blocks 440 disposed within horizontal extrusions 70(*a*) and 70(*b*) of stile 70 fastened by U-shaped channelled member 40 to wall W. Panels 50 and 30 abut upon their edges and may be sealed with silicone or a like water-resistant sealant. Further, clear tape may further secure the joint internally and externally. As best seen in FIG. 1A, stiles 70 and panels 50 and 60 overlap when door members L and R are closed. The amount of overlap is determined by the installer as required by the particular installation wherein said overlap may extend from none to the maximum amount allowed by threaded pin 600 (as best illustrated in FIG. 9). The amount of overlap is generally adjusted by the position of the pivot pins 500 in relation to the pivot block 440 secured within horizontal extrusions 60(*b*), 50(*b*), and 70(*b*) (left and right) respectively. Further, sealing surfaces may be affixed to the underside of horizontal extrusions 60(*b*), 30(*b*) and 50(*b*) to abut with sill 15 of shower basin 10 in all embodiments of the invention. If the optional vertical extrusions 60(*c*) and 30(*c*) are excluded from the shower stall then magnetic seals 80 are installed upon the panels 60 and 30 themselves.

Figure 2:
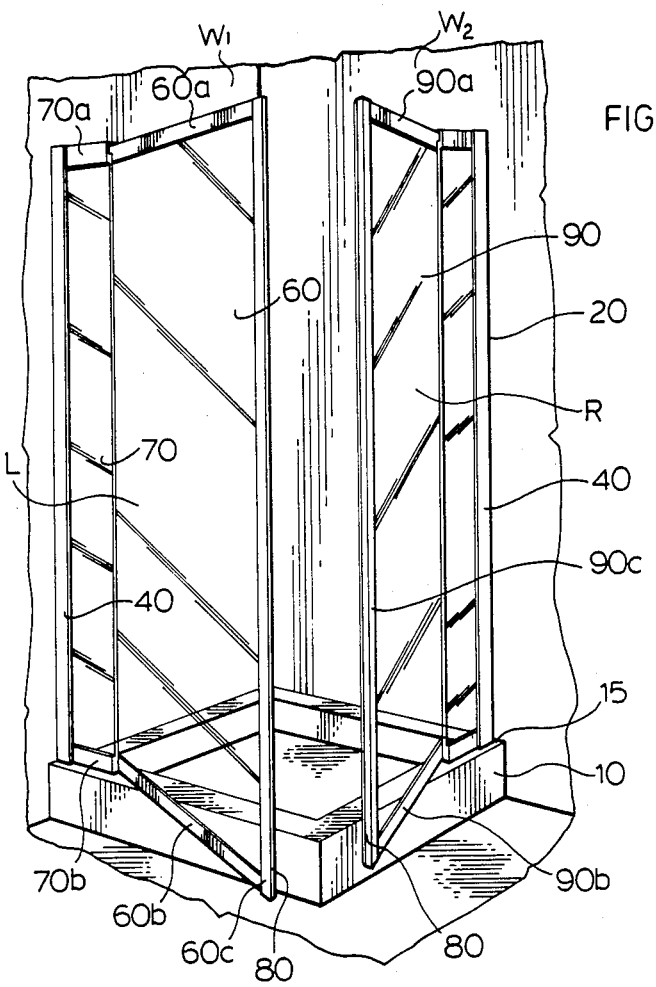
FIG. 2 is a perspective view of a square shower stall depicting an alternative position of the pivoting doors in a preferred embodiment of the invention.
Figure 2A:
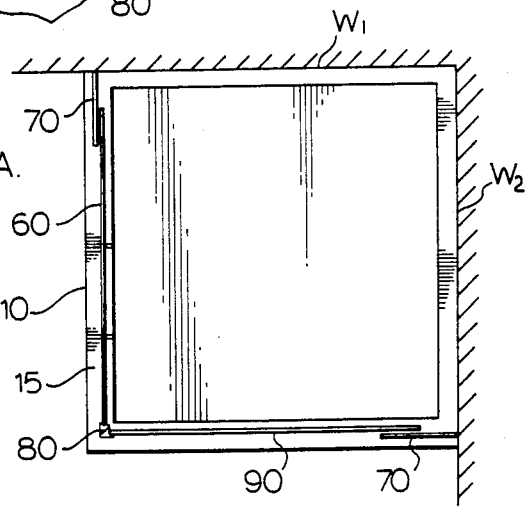
FIG. 2A is a top view of the shower stall of FIG. 2 illustrating the overlapping of the door and stile members in a preferred embodiment of the invention.

Referring now to FIGS. 2 and 2A, shower stall 20 is illustrated in perspective and top view upon a square shower basin as in FIGS. 1 and 1A with the exception that said shower stall is enclosed on two sides by the walls W1 and W2 describing the corner of installation. All other components defining the operation thereof are identical to those of FIG. 1, having a U-shaped channelled jamb affixed to walls W1 and W2 within which stiles 70 are secured upon which doors L and R are secured by pivot mechanisms 440 and 500 respectively, said pivot pins being adjustable in position determining the amount of overlap of the panels 70 and 60, and sealing with magnetic strips extending along vertical extrusions 60(*c*) and 90 (*c*) respectively.

Figure 3:
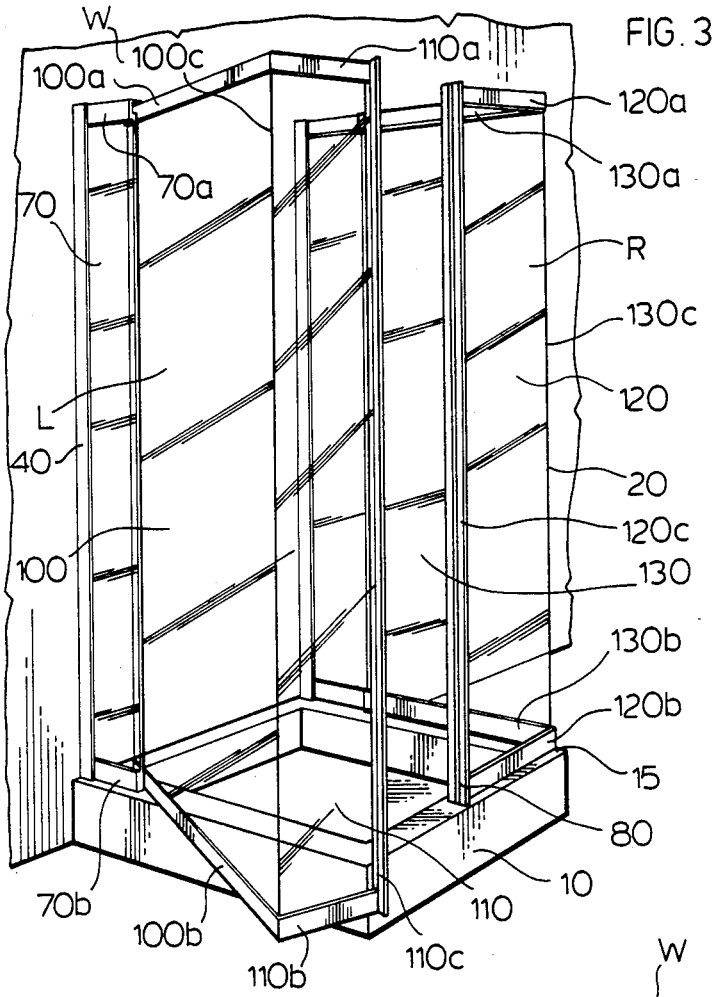
FIG. 3 is a perspective view of an alternative square shower stall depicting the pivoting doors in a preferred embodiment of the invention.
Figure 3A:
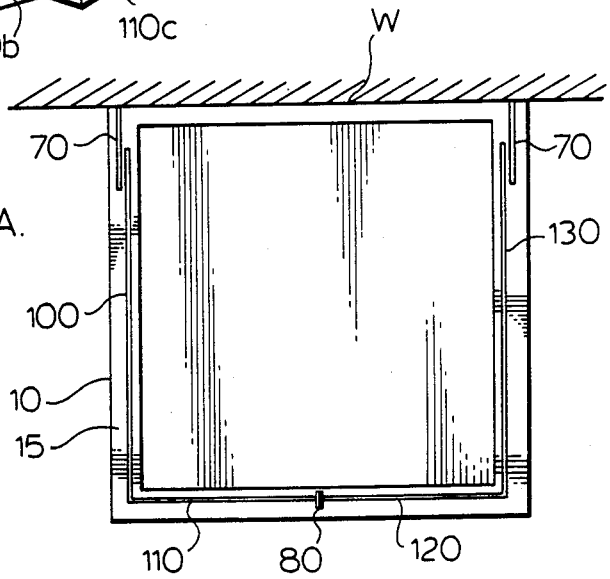
FIG. 3A is a top view of the shower stall of FIG. 3 illustrating the overlapping of the door and stile members in a preferred embodiment of the invention.

Referring now to FIGS. 3 and 3A, shower stall 20 is illustrated in an alternative embodiment having two L-shaped doors L and R similar to door R of FIG. 1 and operating in a very similar manner to FIG. 1 having a primarily U-shaped channelled jamb 40 affixed left and right to wall W with which are secured stiles 70 having horizontal extrusions 70(*a*) and 70(*b*) within which is secured pivot block 440 within which is secured pivot pins 500 secured within horizontal extrusions 100(*a*), 100(*b*) and 130(*a*) and 130(*b*) of panels 100 and 130 of doors L and R respectively. Again, the amount of overlap between stiles 70 and doors L and R is determined by the installer varying from none to the maximum allowed by pin 600 as best seen in FIG. 9. It is apparent that as many shower stalls can be designed and assembled embodying the invention as limited by the shape of the shower basin having double doors which are adjustable in position and enclose the opening defined within the design.

Figure 4:
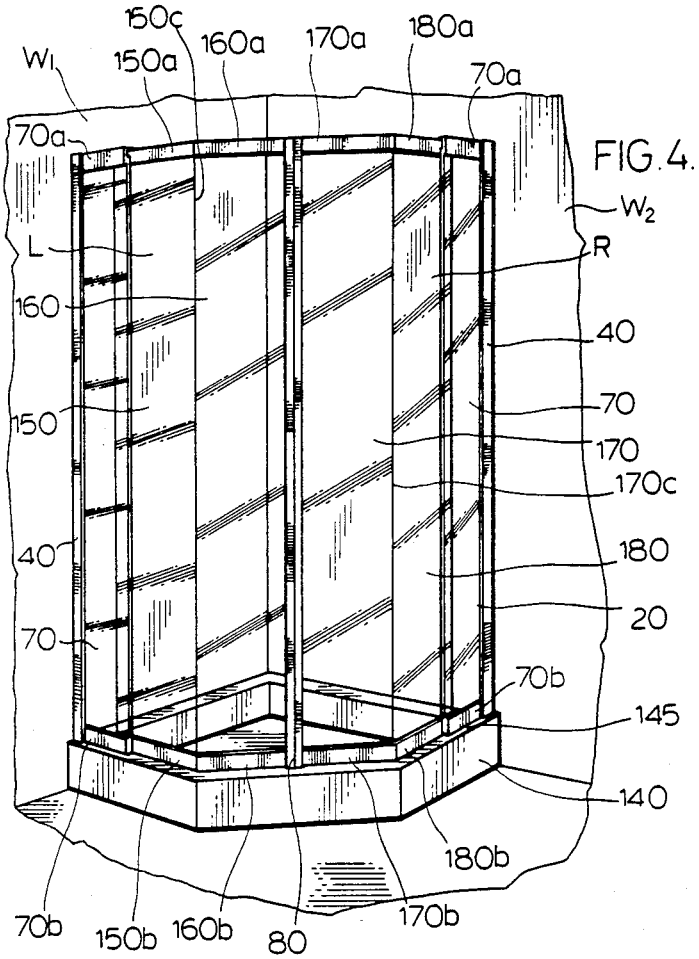
FIG. 4 is a perspective view of an alternative shower stall having as a base a right-angled pentagon basin depicting the closed pivoting doors in a unique resultant shape thereof in a preferred embodiment of the invention.
Figure 4A:
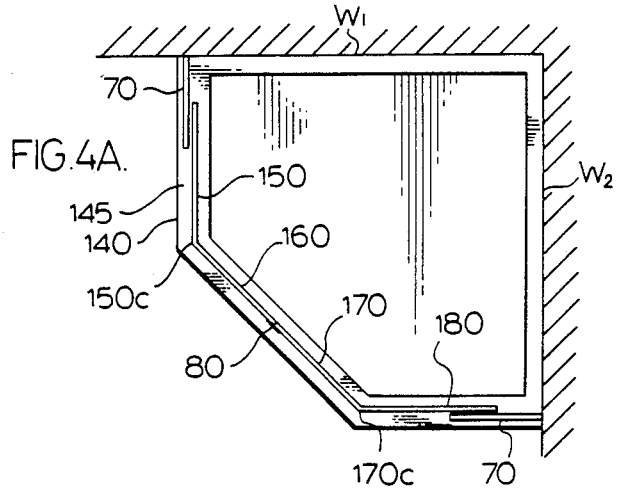
FIG. 4A is a top view of the shower stall of FIG. 4 illustrating the overlapping of the door and stile members in a preferred embodiment of the invention.

Referring to FIGS. 4 and 4A an alternative right-angled pentagon-type of corner shower basin 140 is provided being illustrated in perspective and top view having disposed thereupon an attractive compatibly-shaped shower stall 20 wherein all vertical extrusions have been eliminated providing a cleaner more attractive line and silhouette, with the exception of primarily U-shaped channelled jamb 40 securing within said channel stile 70 having upon its top and bottom horizontal extrusions 70(*a*) and 70(*b*) within which is secured pivot blocks 440 top, bottom, left and right within which is secured pivot pin 500 secured within horizontal extrusions 150(*a*), 150(*b*) and 180(*a*) and 180(*b*) of doors L and R respectively, each of doors L and R comprising two panels angled to each other described by panels 150 and 160, and 170 and 180 and secured within horizontal extrusions 150(*a*), 160(*a*), 150(*b*), 160(*b*), 170(*a*), 180(*a*), 170(*b*) and 180(*b*) respectively. Angled panels 150, 160, and 170, 180 of doors L and R are fastened to each other at joints 150(*c*) and 170(*c*) by conventional sealing means such as silicone and/or transparent tape. Magnetic strips 80 provide sealing surfaces for doors L and R.

Figure 5:
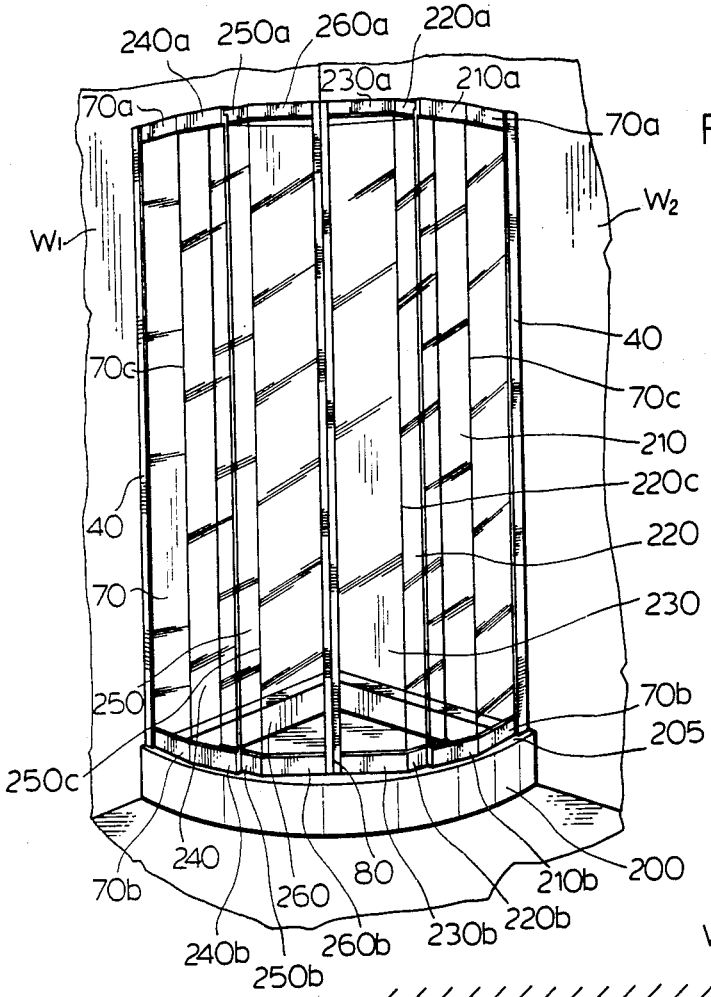
FIG. 5 is a perspective view of an alternative shower stall having as a base a quarter round basin depicting the closed pivoting doors in a unique resultant shape thereof in a preferred embodiment of the invention.
Figure 5A:
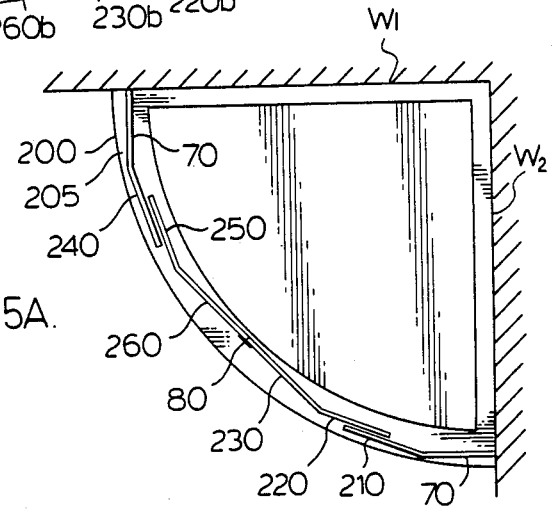
FIG. 5A is a top view of the shower stall of FIG. 5 illustrating the overlapping of the door and stile members in a preferred embodiment of the invention.

FIGS. 5 and 5A illustrate in perspective and top view a further alternative embodiment for a corner shower stall having a quarter round shaped basin 200 but functioning identically to the embodiment depicted in FIGS. 4 and 4A with the exception that stiles 70 are enhanced by angled panels 210 and 240 end doors L and R are slightly smaller in size. All other features of the invention are identical to those embodiments already described.

Referring now to FIGS. 6 and 6A, wherein primarily U-shaped channelled jamb 40 is illustrated in top and side views being a bifurcated unit having two side members 300 joined by arcuate member 310 and separated by channel 330 wherein panel P is secured within channel 330 by serrated edges 220 upon the interior surfaces of side members 300 encouraged by an appropriate caulking compound or silicone sealant layered within channel 330 prior to insertion of panel P and therafter occupying the space between edges 220 and panel P. It should be noted that if a wall were not perfectly vertical during installation, that it is very easy to compensate by locating the upper or lower positions of panel P further back within the channel 330 at an opposite complementary angle to the amount which the wall is out of plumb with the vertical (as is generally indicated by example as the dashed line in FIG. 6A).

Referring now to FIG. 7, horizontally-extruded glazing section 70(*b*) is illustrated in perspective having a top 410, bottom 400, and plurality of sides, having upon its top 410 a channel 410(*a*) enclosed by bifurcated portions 405 for securing panel P within channel 410(*a*) between bifurcated portions 405 using appropriate caulking compound or silicone sealant and the channel edge thereof is finished by finishing member F whose extensions are inserted within orifices disposed within the channel edge perimeter; said glazing section 70(*b*) having upon its bottom 400 a channel 420 having upon its edges guides 420(*a*) and 420(*b*) into which fastening portion 430 of pivot block 440 is inserted having compatibly-shaped shoulders 460(*a*) and 460(*b*) which align and abut with edge guides 420(*a*) in use being secured by fasteners $S_1$ and $S_2$ inserted in built-up holes (not shown) upon the bottom of said glazing section 70(*b*) and passing through the holes $H_1$ and $H_2$ within pivot block 430, which has a channel 460 between shoulders 460(*a*) and 460(*b*) which allow the underside of the holes upon the bottom of the glazing section to be materially built up and to enhance securing of the pivot block 440 within the glazing section 70(*b*). The identical arrangement would be applicable to glazing section 70(*a*) of, for example, FIG. 1 with the orientation being the only fundamental difference.

Figure 10:
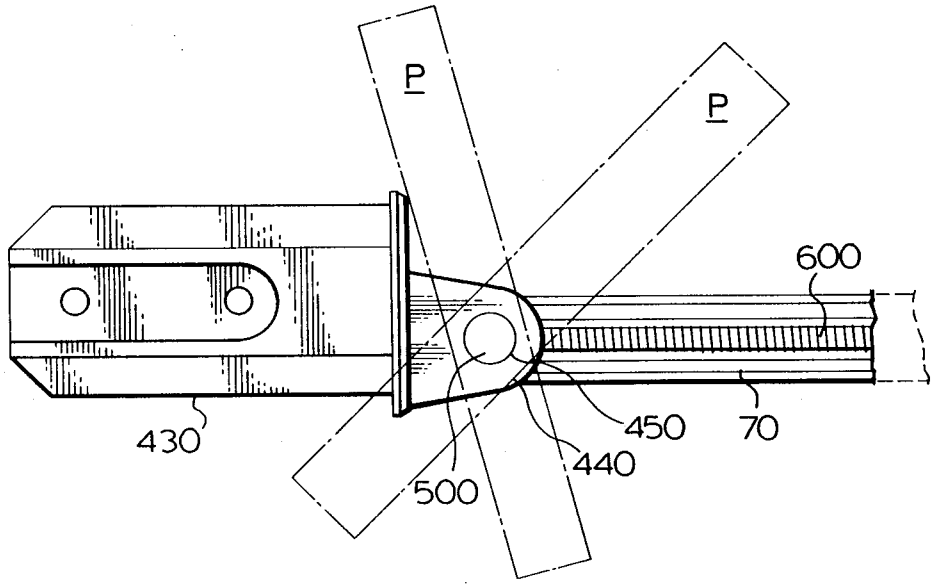
FIG. 10 is a top view or alternatively bottom view of a pivot block and a pivot pin illustrating a secured closure member pivoting thereon in a preferred embodiment of the invention.

Referring now to FIGS. 8, 9 and 10, pivot block 440 is illustrated in perspective top and side views in isolation from the glazing section, for example, 70(*a*) of FIG. 1 having a hole 450 upon its top within which a pivot pin 500 engages in use said pin 500 embodied upon pin carrier 501 being internally threaded to receive threaded pin 600 (as best illustrated in FIG. 9) the head thereof 510 being rotated clockwise or counterclockwise to position the pin 500 at the desired location to compatibly align with hole 450 of pivot block 440. Alternatively, the head 510 of pin 600 may be counter sunk any accessible distance and locked along its housing by capturing the head thereon in distorted metal notches disposed upon the housing perimeter to allow for maximum adjustment on site by an installer and hence determine the amount of overlap of glazing section 60(*a*) and 70(*b*) and hence door L with stile 70 as illustrated in FIG. 1 but applicable as well in FIGS. 2 through 5.

As many changes can be made to the preferred embodiments without departing from the scope of the invention, it is intended that all matter contained herein be interpreted as illustrative of the invention and not in a limiting sense.

The embodiments of the invention in which an exclusive property or privilege is claimed are as follows:

1. In combination a shower stall structure for bathtubs or shower basins having a top and bottom comprising at least one opening extending from top to bottom defined by a multiplicity of stiles, each stile extending in both a horizontal and vertical direction abutting an adjacent wall or stile, wherein said at least one opening is closed by more than one closure member spanning across said at least one opening, having pivot mechanisms carried by both said multiplicity of stiles and said more than one closure member at the peripheral extremities thereof wherein said pivot mechanisms are adjustable in position along the respective peripheral edges of at least one of said multiplicity of stiles and said more than one closure member, allowing for dimensional variation of said at least one opening with respect to the dimensions of the corner in which the shower stall is installed.

2. In combination a shower structure for bathtubs or shower basins having a top and bottom comprising at least one opening extending from top to bottom defined by a multiplicity of stiles, each stile extending in both a horizontal and vertical direction abutting an adjacent wall or stile, wherein said at least one opening is closed by more than one closure member, spanning across said at least one opening, in inward overlapped relation with said multiplicity of stiles, having pivot mechanisms carried by both said multiplicity of stiles and said more than one closure member at the top and bottom extremities thereof, wherein said pivot mechanisms are adjustable in position along the respective upper and lower edges of at least one of said multiplicity of stiles and said more than one closure member allowing for dimensional variation of said at least one opening with respect to the dimensions of the corner in which the shower stall is installed according to the amount of overlap desired.

3. A disassembled kit for a shower stall structure for bathtubs and shower basins comprising once assembled a top and a bottom, said shower stall having at least one opening extending from top to bottom defined by a multiplicity of stiles, each stile extending in both a horizontal and vertical direction abutting an adjacent wall or stile, wherein said at least one opening is closed by more than one closure member spanning across said at least one opening in inward overlapped relation with said multiplicity of stiles, having pivot mechanisms carried by both said multiplicity of stiles and said more than one closure member at the top and bottom extremities thereof, wherein said pivot mechanisms are adjustable in position along the respective upper and lower edges of at least one of said multiplicity of stiles and said more than one closure member allowing for dimensional variation of said at least one opening with respect to the dimensions of the corner in which the shower stall is installed.

4. The shower stall structure of claim 1, wherein a multiplicity of shower stalls having compatible geometry with the specific shower basin and or bathtubs enclosed is provided comprising such shapes as square, rectangular, quarter round, right-angled pentagonal, triangular, circular and elliptical cross-section configurations.

5. The shower stall structure of claim 2, wherein a multiplicity of shower stalls having compatible geometry with the specific shower basin and or bathtubs enclosed is provided comprising such shapes as square, rectangular, quarter round, right-angled pentagonal, triangular, circular and elliptical cross-section configurations.

6. The shower stall structure of claim 3, wherein a multiplicity of shower stalls having compatible geometry with the specific shower basin and or bathtubs enclosed is provided comprising such shapes as square, rectangular, quarter round, right-angled pentagonal, triangular, circular and elliptical cross-section configurations.

7. The shower stall structure of claim 1, wherein the pivot mechanism carried by both said multiplicity of stiles and said more than one closure member at the upper and lower extremities thereof comprise a pivot block or pivot pin disposed upon the inner and outer extremities of the panel framing extrusions of a shower stall, wherein at least one of said block and said pin are adjustable in position by an adjustment defined by a rotatable threaded pin in communication with said pivot mechanism.

8. The shower stall structure of claim 2, wherein the pivot mechanisms carried by both said multiplicity of stiles and said more than one closure member at the upper and lower extremitites thereof comprise a pivot block or pivot pin disposed upon the inner and outer extremities of the panel framing extrusions of a shower stall, wherein at least one of said block and said pin are adjustable in position by an adjustment defined by a rotatable threaded pin in communication with said pivot mechanism.

9. The shower stall structure of claim 3, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein at least one of said block and said pin are adjustable in position by an adjustment defined by a rotatable threaded pin in commumication with said pivot mechanism.

10. The shower stall structure of claim 4, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein at least one of said block and said pin are adjustable in position by an adjustment defined by a rotatable threaded pin in communication with said pivot mechanism.

11. The shower stall structure of claim 5, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein at least one of said block and said pin are adjustable in position by an adjustment defined by a rotatable threaded pin in communication with said pivot mechanism.

12. The shower stall structure of claim 6, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein at least one of said block and said pin are adjustable in position by an adjustment defined by a rotatable threaded pin in communication with said pivot mechanism.

13. The shower stall structure of claim 1, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein said block and said pin are telescopically adjustable in position.

14. The shower stall structure of claim 2, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein said block and said pin are telescopically adjustable in position.

15. The shower stall structure of claim 3, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein said block and said pin are telescopically adjustable in position.

16. The shower stall structures of claim 4, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein said block and said pin are telescopically adjustable in position.

17. The shower stall structure of claim 5, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein said block and said pin are telescopically adjustable in position.

18. The shower stall structure of claim 6, wherein the pivot mechanisms carried by both said multiplicity of stiles and said more than one closure member at the upper and lower extremities thereof comprise a pivot block or pivot pin disposed upon the inner and outer extremities of the panel framing extrusions of a shower stall, wherein said block and said pin are telescopically adjustable in position.

19. The shower stall structure of claim 1, wherein there are no vertical extrusions or horizontal framing header sections and wherein silicone sealant is used to fasten abutting vertical edges further secured by tape.

20. The shower stall structure of claim 2, wherein there are no vertical extrusions or horizontal framing header sections and wherein silicone sealant is used to fasten abutting vertical edges further secured by tape.

21. The shower stall structures of claim 3, wherein there are no vertical extrusions or horizontal framing header sections and wherein silicone sealant is used to fasten abutting vertical edges further secured by tape.

22. The shower stall structure of claim 4, wherein there are no vertical extrusions or horizontal framing header sections and wherein silicone sealant is used to fasten abutting vertical edges further secured by tape.

23. The shower stall structure of claim 5, wherein there are no vertical extrusions or horizontal framing header sections and wherein silicone sealant is used to fasten abutting vertical edges further secured by tape.

24. The shower stall structure of claim 6, wherein there are no vertical extrusions or horizontal framing header sections and wherein silicone sealant is used to fasten abutting vertical edges further secured by tape.

25. The shower stall structure of claim 1, wherein a primarily U-shaped channelled jamb comprises sufficient depth to permit sufficient adjustment of a stile to properly finish a shower stall even though the supporting wall is not plumb.

26. The shower stall structure of claim 2, wherein a primarily U-shaped channelled jamb comprises sufficient depth to permit sufficient adjustment of a stile to properly finish a shower stall even though the supporting wall is not plumb.

27. The shower stall structure of claim 3, wherein a primarily U-shaped channelled jamb comprises sufficient depth to permit sufficient adjustment of a stile to properly finish a shower stall even though the supporting wall is not plumb.

28. The shower stall structure of claim 4, wherein a primarily U-shaped channelled jamb comprises sufficient depth to permit sufficient adjustment of a stile to properly finish a shower stall even though the supporting wall is not plumb.

29. The shower stall structure of claim 5, wherein a primarily U-shaped channelled jamb comprises sufficient depth to permit sufficient adjustment of a stile to properly finish a shower stall even though the supporting wall is not plumb.

30. The shower stall structure of claim 6, wherein a primarily U-shaped channelled jamb comprises sufficient depth to permit sufficient adjustment of a stile to properly finish a shower stall even though the supporting wall is not plumb.

31. The shower stall structure of claim 1, wherein a latch means is provided comprising magnetic strips to seal the more than one closure members.

32. The shower stall structure of claim 2, wherein a latch means is provided comprising magnetic strips to seal the more than one closure members.

33. The shower stall structure of claim 3, wherein a latch means is provided comprising magnetic strips to seal the more than one closure members.

34. The shower stall structures of claim 4, wherein a latch means is provided comprising magnetic strips to seal the more than one closure members.

35. The shower stall structure of claim 5, wherein a latch means is provided comprising magnetic strips to seal the more than one closure members.

36. The shower stall structure of claim 6, wherein a latch means is provided comprising magnetic strips to seal the more than one closure members.

37. The shower stall structure of claim 1, wherein a pivot block is incorporated within the extruded horizontal glazing section of the stile framing members.

38. The shower stall structure of claim 2, wherein a pivot block is incorporated within the extruded horizontal glazing section of the stile framing members.

39. The shower stall structure of claim 3, wherein a pivot block is incorporated within the extruded horizontal glazing section of the stile framing members.

40. The shower stall structure of claim 4, wherein a pivot block is incorporated within the extruded horizontal glazing section of the stile framing members.

41. The shower stall structure of claim 5, wherein a pivot block is incorporated within the extruded horizontal glazing section of the stile framing members.

42. The shower stall structure of claim 6, wherein a pivot block is incorporated within the extruded horizontal glazing section of the stile framing members.

* * * * *

UNITED STATES PATENT AND TRADEMARK OFFICE

CERTIFICATE OF CORRECTION

PATENT NO. : 4,720,876

DATED : January 26, 1988

INVENTOR(S) : Vincent Tomei, Alfred MacLean, Michel Morand, and John Faveri

It is certified that error appears in the above-identified patent and that said Letters Patent is hereby corrected as shown below:

At column 1, line 8 after 'member' and before 'across', "opening" should be changed to ---spanning---;

At column 5, line 19 after '50(a)' and before 'and 50(b)', "," should be deleted;

At column 9, line 9 after 'pin in' and before 'with said', "commumication" should be corrected to read ---communication---.

Signed and Sealed this

Twenty-sixth Day of June, 1990

*Attest:*

HARRY F. MANBECK, JR.

*Attesting Officer*

*Commissioner of Patents and Trademarks*